United States Patent [19]

Takegawa

[11] Patent Number: 4,530,381

[45] Date of Patent: Jul. 23, 1985

[54] WEFT RESERVOIR CONTROLLER USED FOR FREELY CHANGEABLE ALTERNATE WEAVING ON A FLUID-JET LOOM

[75] Inventor: Yujiro Takegawa, Shizuoka, Japan

[73] Assignee: Tsudakoma Kogyo Kabushiki Kaisha, Japan

[21] Appl. No.: 561,325

[22] Filed: Dec. 14, 1983

[30] Foreign Application Priority Data

Dec. 27, 1982 [JP] Japan ..... 57-234712

[51] Int. Cl.[3] ..... D03D 47/36

[52] U.S. Cl. ..... 139/452; 242/47.01

[58] Field of Search ..... 139/435, 452; 242/47.01, 47.04, 47.05, 47.06, 47.09; 66/132 R

[56] References Cited

U.S. PATENT DOCUMENTS 4,368,854 1/1983 Valois ..... 139/452
4,372,349 2/1983 Mullekom ..... 139/452
4,386,633 6/1983 Shin ..... 139/452
4,397,340 8/1983 Umezawa et al. ..... 139/452

*Primary Examiner*—Henry S. Jaudon
*Attorney, Agent, or Firm*—Ostrolenk, Faber, Gerb & Soffen

[57] ABSTRACT

In operation control of a plurality of weft reservoirs for freely changeable alternate weaving, winding and delivering functions are separately controlled by a central processing unit electrically connected to yarn guide drive motors and control pin drive solenoids on the weft reservoirs in order to avoid need for advanced sequence adjustment between the weft reservoirs. The winding function is controlled in response to a count-up signal combined with a delivery-over signal both quite unrelated to loom operational sequence whereas the delivery function is controlled in response to a clock-pulse combined with a weft-insertion command both closely related to the loom operational sequence.

4 Claims, 6 Drawing Figures

WEFT RESERVOIR CONTROLLER USED FOR FREELY CHANGEABLE ALTERNATE WEAVING ON A FLUID-JET LOOM

BACKGROUND OF THE INVENTION

The present invention relates to a weft reservoir controller used for freely changeable alternate weaving on a fluid-jet loom, and more particularly relates to an improvement in control of a weft reservoirs used for a fluid-jet loom in which two or more sets of weft reservoirs are used in combination for sequential reservation and delivery of weft under pin control.

In the construction of a weft reservoir of the above-described type, a yarn guide used for winding of a weft is rigidly and mechanically coupled to a control pin or pins used for delivery of the weft. That is, since the winding function is closely related to the delivering function of the reservoir, any change in one function unavoidably accompanies a corresponding change in the other function. As a consequence, operational sequence of the reservoir has to be strictly timed to that of the loom for which the reservoir is used. In other words, precise sequence adjustment has to be carried out at the stage of preparatory winding on the reservoir.

This need for the advanced sequence adjustment is quite unsuited for freely changeable alternate weaving in which different wefts are inserted into sheds following a given programme. A plurality of weft reservoirs are used for freely changeable alternate weaving and the number of the weft reservoirs corresponds in general to that of the type of wefts to be used. In order to adequately meet the recent general demand in market for supply of textile products of various types, it has become necessary at factories to change the mode of alternate weaving frequently. For example, the mode is changed from two-pick alternate weaving with two different wefts to one-pick alternate weaving with three different wefts. At every change in mode of alternate weaving, the above-described sequence adjustment has to be performed on all reservoirs to be involved in the new alternate weaving. This work requires a great deal of manual labor while resulting in significant rise in production cost. In addition, the need for manual maintenance forms a serious bar to smooth introduction of automation into the process of freely changeable alternate weaving.

SUMMARY OF THE INVENTION

It is one object of the present invention to remove the need for the advanced sequence adjustment on weft reservoirs in practice of freely changeable alternate weaving on fluid-jet looms.

It is the other object of the present invention to promote introduction of automation into the process of freely changeable alternate weaving.

In accordance with the basic aspect of the present invention, a weft reservoir controller includes a plurality of wind-number counters arranged, one for each, at different weft reservoirs and collectively connected to a central processing unit which separately controls winding and delivering functions of each weft reservoir. The central processing unit operates, for control of the winding function, in response to count-up signals produced independently of operational sequence of a loom for which the weft reservoirs are used. For control of the delivering function, operation of the central processing unit is further caused by clock pulses whose production is closely related to the operational sequence of the loom.

DESCRIPTION OF THE PREFERRED EMBODIMENTS

Figure 1:
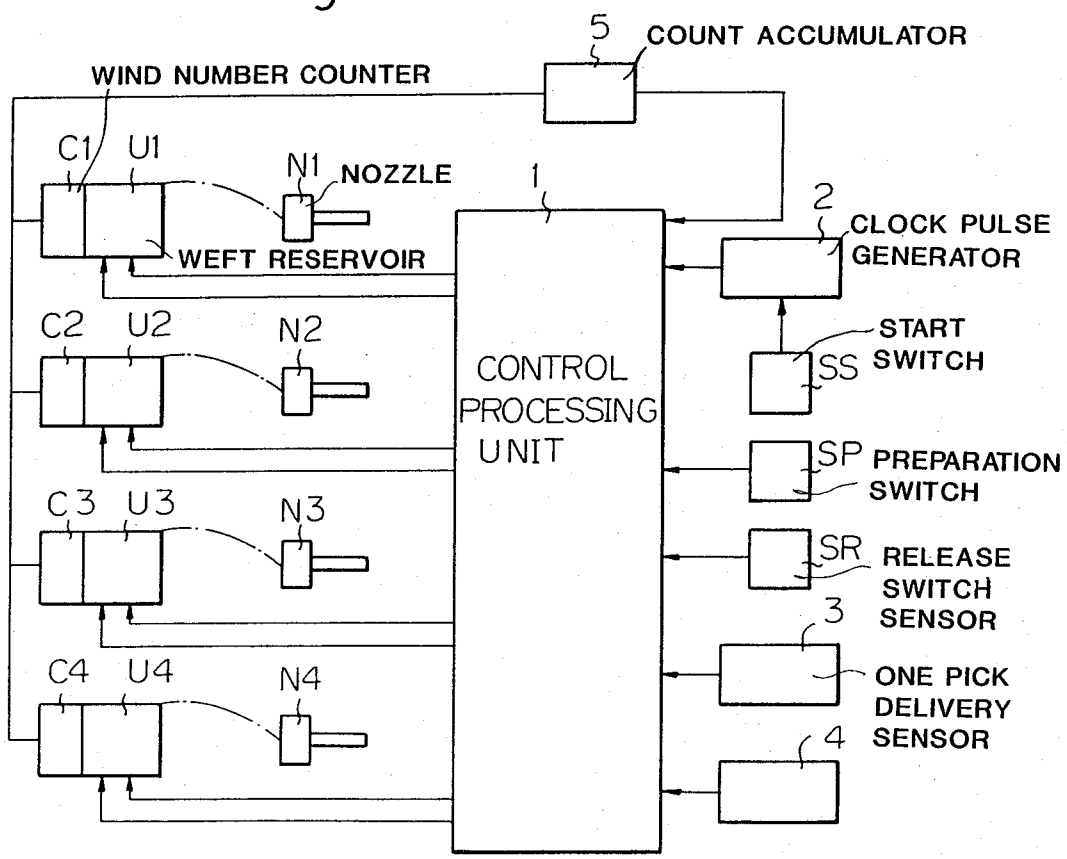
FIG. 1 is a block diagram for showing the construction of one embodiment of the weft reservoir controller in accordance with the present invention.

One embodiment of the weft reservoir controller in accordance with the present invention is shown in FIG. 1, in which the weft reservoir controller includes four sets of weft reservoirs U1 to U4 for practice of freely changeable alternate weaving with four different wefts. However, application of the present invention is not limited to this mode of alternate weaving. Any change in number of different wefts to be inserted accompanies a mere corresponding change in number of weft reservoirs to be used, but no change in the basic construction of the weft reservoir controller.

A central processing unit 1 (e.g. an IBM '4300 processor) forms the heart of the weft reservoir controller in accordance with the present invention and operates as later described in more detail following a stored programme which is designed in accordance with the mode of alternate weaving to be performed on a loom for which the weft reservoirs U1 to U4 are used. As well known in the art, such a programme may be taken from a appropriate outside memory or memories.

The central processing unit 1 is electrically connected to three manually operable switches, i.e. a preparation switch SP, a start switch SS and a release switch SR. The preparation switch SP is turned on in order to initiate preparatory winding on the weft reservoirs U1 to U4. When the preparatory winding is over, reservation of weft and control pins on different weft reservoirs are all placed under the same condition. As a result, main winding begins at any of weft reservoirs under the same initial condition. The start switch ST is used in connection with main winding control. When this switch ST is turned on, the loom starts running and a clock pulse generator 2 generates a clock pulse at a prescribed moment in one crank rotation of the loom in order to pass it to the central processing unit 1. Obviously, production of the clock pulses is closely related to operational sequence of the loom. The release switch SR is used for operating the control pins on the weft reservoirs U1 to U4 independently of the programme followed by the central processing unit 1.

A one-pick delivery sensor 3 (one example of such a sensor is described in U.S. Pat. No. 3,853,408) is arranged on the lathe of the loom on the weft arrival side in order to detect delivery of weft for one pick on a weft reservoir. When one-pick delivery is completed on a weft reservoir, the one-pick delivery sensor 3 generates a delivery-over signal and applies it to the central processing unit 1. A weft-insertion command generator 4 is arranged on the loom. This generator 4 is of a known type see, e.g., U.S. Pat. No. 3,761,031 and generates a weft insertion command at a predetermined moment in each crank rotation of the loom and applies it to the central processing unit 1.

The weft reservoirs U1 to U4 each attached to a respective main nozzle N1 to N4 for supply of weft. The weft reservoirs U1 to U4 are each accompanied, with a respective with wind-number counter C1 to C4. Further, each weft reservoir includes a weft reservoir drum, a yarn guide, a drive motor and one or more control pins. Every time a weft is wound a single revolution on the reservoir drum of a weft reservoir, an associated wind-number counter counts this winding and passes a count signal to a count accomulator 5 which is electrically connected to the wind-number counters C1 to C4 of the weft reservoirs U1 to U4. The count accumulator 5 accumulates the count signals from each wind-number counter and generates a count-up signal every time its accumulation reaches a given full count value. Upon every generation of the count-up signal, the count accumulator 5 is automatically reset and the generated count-up signal is passed to the central processing unit 1.

Output terminals of the central processing unit 1 are electrically connected to drive motors for the yarn guides and drive solenoid for the control pins on the weft reservoirs U1 to U4.

Figure 2A:
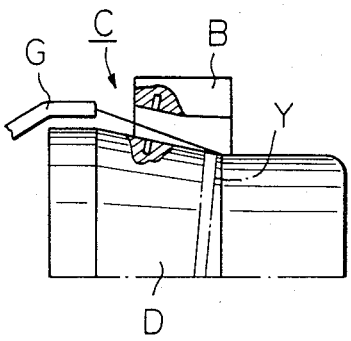
FIGS. 2A and 2B are simplified side views of different embodiments of a wind-number counter usable for the weft reservoir controller shown in FIG. 1.
Figure 2B:
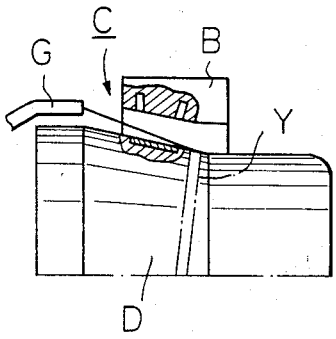

One example of the wind-number counter C which can be used for the weft reservoir controller in accordance with the present invention is shown in FIG. 2A, in which the wind-number counter C includes a photoelectric beam projector arranged on a balloon breaker B and a photoelectric beam sensor arranged on the reservoir drum facing the beam projector. The arrangement may be reversed. A modification is shown in FIG. 2B. In this case, the wind-number counter C includes photoelectric beam projector and sensor arranged on a balloon breaker B and a beam reflector arranged on the reservoir drum D in a manner to reflect the beam from the projector towards the sensor.

In either case, weft Y issued from the yarn guide G and running into the conical section of the reservoir drum D intersects the beam radiated by the projector once per one winding on the reservoir drum D. One count signal is generated by the wind-number counter C each time the weft Y crosses the sensor and the count signal is transmitted to the count accumulator 5. Any other type of wind-number counter may be used for the weft reservoir controller as long as it generates one count signal per one winding of weft on the reservoir drum D.

The central processing unit 1 operates following the given programme in response to various inputs. Some examples of the operation are listed below.

(I) To generate a start command for the drive motor of the yarn guide on each weft reservoir when the preparation switch SP is turned on.

(II) To generate a start command for the drive solenoid of the control pin or pins on each weft reservoir every time the count accumulator 5 has generated the count up signal.

(III) To generate a stop command for the drive motor of the yarn guide when accumulation at the count accumulator 5 has reached a prescribed value set by the employed programme.

(IV) To generate an indication when preparatory winding is over on all weft reservoirs U1 to U4.

(V) To generate a command for practice of sequential delivery of weft from the weft reservoirs in a programmed order.

(VI) To generate a start command for the solenoid of the control pin or pins upon receipt of each clock pulse and each weft-insertion command signal.

(VII) To generate a plurality of start commands for the solenoids with a prescribed time difference upon receipt of a delivery-over signal from the one-pick delivery sensor 3.

In addition to the above-described operations, the central processing unit 1 is capable of performing various operations depending on the content of the programme it follows.

Figure 3:
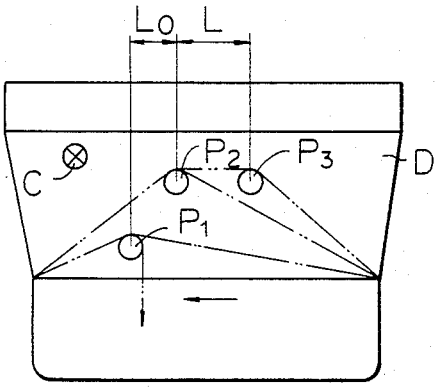
FIG. 3 is a simplified plan view for showing proper allocation of the wind-number counter in relation to three control pins.
Figure 4:
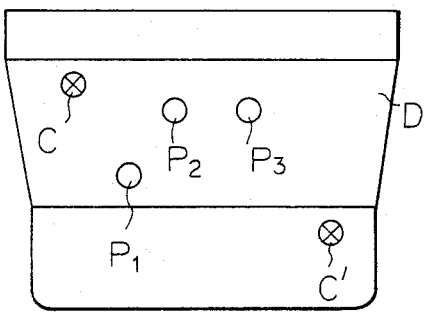
FIG. 4 is a simplified plan view for showing proper allocation of the delivery-over signal generator usable for the weft reservoir controller shown in FIG. 1.

Proper allocation of the wind-number counter C in relation to control pins on each weft reservoir will now be explained with reference to FIG. 3, in which three control pins P1 to P3 are used in combination. Among the three pins, the first control pin P1 controls delivery of weft from the reservoir drum D whereas the second and third control pins P2 and P3 control reservation of weft on the reservoir drum D. Weft is first reserved on the upstream side of the second or third control pin P2, P3 for certain winds (e.g. four winds) and subsequently assigned to the first control pin P1. As the first control pin P1 leaves its operative zone on the reservoir drum D, the weft is delivered from the reservoir drum D for insertion of weft by an associated main nozzle.

For smooth and successful practice of such inter-pin assignment of weft on the weft reservoir drum D, the three control pins P1 to P3 should preferably be arranged in the following fashion.

In the illustration, the weft delivering direction is indicated by an arrow. It is assumed that the second control pin P2 is located on the downstream side of the third control pin P3 when seen in the weft delivering direction. Then, the second control pin P2 should be located outside a triangular zone defined by a weft in engagement with the third control pin P3. Likewise, the third control pin P3 should be located outside a triangular zone defined by a weft in engagement with the second control pin P2. Further, the second and third control pins P2 and P3 should be separated from each other by a distance L substantially on a same circumferential line on the reservoir drum D. Again seen in the weft delivering direction, the first control pin P1 should be separated downstream from the second control pin by a distance Lo. When seen in the axial direction of the reservoir drum D, the first control pin P1 should be located closest to the weft delivery end of the reservoir drum D.

In the case of the illustrated embodiment, the wind-number counter C is located closest to the weft supply end of the reservoir drum D.

The weft reservoir controller of the above-described construction operates as follows.

First, preparatory winding of weft is carried out concurrently on all the weft reservoir units U1 to U4. As the preparation switch SP is turned on, the central processing unit 1 generates a drive motor start command which is passed to the reservoir units U1 to U4 in order to initiate running of their drive motors. Thus, on each weft reservoir, the yarn guide G is driven for rotation in order to wind the weft Y on the associated reservoir drum D.

For example on the first weft reservoir U1, the counter C1 counts winding of weft on the upstream side of the first control pin P1 and, at every winding of weft, delivers a count signal to be passed to the count accumulator 5. The full count for the accumulator 5 is chosen so that its accumulation should reach the full count when the weft for one pick has been reserved on the upstream side of the first control pin P1.

As the accumulation reaches the full count, the count accumulator 5 counts up and delivers a count-up signal to be passed to the central processing unit 1. On receipt of this count-up signal from the accumulator 5, the central processing unit 1 generates and passes a second solenoid drive command to the first weft reservoir U1. Then, the second solenoid on the weft reservoir U1 is activated and the second control pin P2 is driven for advance into its operative zone on the reservoir drum. As a result, reservation of weft is now initiated on the upstream side of the second control pin P2. Winding of weft is again counted by the wind-number counter C1 for generation of count signals. After delivery of each count-up signal, the accumulator 5 is automatically reset.

When weft for one pick has been reserved on the upstream side of the second control pin P2, the accumulator 5 again counts up and delivers a count-up signal to be passed to the central processing unit 1. Thereupon the central processing unit 1 generates and passes a third solenoid drive command to the first weft reservoir U1. Then, the third solenoid on the weft reservoir U1 is activated and the third control pin P3 is driven for advance into its operative zone on the reservoir drum. As a result, reservation of weft is initiated on the upstream side of the third control pin P3. Winding of weft is again counted by the wind-number counter C1 for generation of corresponding count signals.

The count signals from the counter C1 is accumulated at the accumulator 5. In the foregoing cases, the accumulator 5 delivers a count-up signal when weft for one pick has been reserved on the weft reservoir U1 and the central processing unit 1 operates in response to such a count-up signal from the accumulator 5. In the present case, however, the central processing unit 1 operates in a different manner. When accumulation at the accumulator 5 has reached a prescribed value set by the employed programme, the central processing unit 1 delivers and passes a drive motor stop command to the weft reservoir U1. It should be noted that the above-described prescribed value does not necessarily correspond to reservation of weft for one pick. In addition, the value is freely adjustable depending on the real process condition in the alternate weaving by various known ways. The stop command stops running of the drive motor on the weft reservoir U1 and the yarn guide ceases its rotation in order to terminate the preparatory winding. Preparatory winding is carried out in the same manner also on other weft reservoirs U2 to U4 and the central processing unit 1 generates a visible and/or audible indication when preparatory winding is over on all the weft reservoirs U1 to U4.

At the moment when the preparatory winding is thus over, weft for one pick is reserved on the upstream side of the first control pin P1, weft for one pick is reserved also on the upstream side of the second control pin P2, and weft of an amount set by the employed programme is reserved on the upstream side of the third control pin P3 on each weft reservoir. As a consequence, the weft reservoirs U1 to U4 are all ready for normal weft delivery.

Sequence of weft delivery from different weft reservoirs is set by the employed programme.

As the end of the preparatory winding is indicated by the central processing unit 1, the start switch SS is manually turned on to start running of the loom. The start switch SS also activates the clock pulse generator 2 which generates a clock pulse at a prescribed moment in each crank rotation of the loom in order to pass it to the central processing unit 1. As already described, generation of the clock pulses is closely related to the operational sequence of the loom. A weft-insertion command is passed to the central processing unit 1 from the weft-insertion command generator 4 once per one crank rotation of the loom. On receipt of the clock pulse and the weft-insertion command, the central processing unit 1 delivers a first solenoid start command signal to be passed to a weft reservoir, e.g. the first weft reservoir U1, which supplies weft to a main nozzle to insert weft first. Then the first solenoid is activated in order to drive the first control pin P1 for recession from its operational zone on the reservoir drum. As a consequence, the weft reserved on the upstream side of the first control pin P1 is delivered from the reservoir drum due to traction of the main nozzle N1.

Complete delivery of weft for one pick is detected by the one-pick delivery sensor 3 which thereupon passes a delivery-over signal to the central processing unit 1. On receipt of this delivery-over signal, the central processing unit 1 passes first a first solenoid start command signal and secondly, with some time lag, a second solenoid start command signal to the weft reservoir U1. As a result at the weft reservoir U1, the first solenoid is first activated to drive the first control pin P1 for advance into its operative zone and the second solenoid is next activated to drive the second control pin P2 for recession from its operative zone. The weft for one pick reserved on the upstream side of the second control pin P2 slides over the conical section of the reservoir drum and is taken over by the first control pin P1.

Of the weft reserved on the upstream side of the third control pin P3 is less in amount than weft for one pick at the moment when the preparatory winding is over, the initial amount reserved has to be increased to be equal to the amount of weft for one pick needed for the later described weft assignment from the third to first control pin. To this end, the central processing unit 1 passes drive motor start and stop commands to the weft reservoir U1 at a proper moment between the turning-on of the start switch SS and the weft assignment from the second to first control pin. By this input of the commands, the drive motor on the weft reservoir is provisionally activated to rotate the yarn guide for a limited period. By this provisional rotation of the yarn guide, additional weft is wound on the upstream side of the third control pin P3 in order to increase the above-described initial reservation of weft for one pick.

With a slight time lag from input of the delivery-over signal issued by the one-pick delivery sensor 3, the central processing unit 1 passes a second solenoid start command signal to the weft reservoir U1. This command signal activates the second solenoid to drive the second control pin P2 for advance into its operative zone on the reservoir drum. Right after this movement of the second control pin P2, the central processing unit 1 passes a motor start command to the weft reservoir U1. This command activates the drive motor to drive the yarn guide for rotation so that weft should be wound on the reservoir drum on the upstream side of the second control pin P2.

Now the main winding starts on the first weft reservoir U1. Every time weft is wound once on the reservoir drum, the wind-number counter C1 counts the winding and a count signal is passed to the count accumulator 5 as in the case of the above-described preparatory winding.

The count accumulator 5 counts up when weft for one pick is reserved on the upstream side of the second control pin P2 and a count-up signal is passed to the central processing unit 1. On receipt of this signal, the central processing unit 1 delivers a drive motor stop command which is passed to the first weft reservoir U1. This command stops running of the drive motor, i.e. rotation of the yarn guide.

With further advance of the weaving cycle, a weft-insertion command signal is delivered by the generator 4 and passed to the central processing unit 1 in addition to a clock pulse from the generator 2. On receipt of the two inputs, the central processing unit 1 generates a first solenoid start command, which is passed to the first weft reservoir U1. This command activates the first solenoid to drive the first control pin P1 for recession from its operative zone on the reservoir drum. As a result, the weft reserved on the upstream side of the first control pin P1 is delivered from the reservoir drum due to traction of the first main nozzle N1.

As the delivery of weft for one pick is over, the one-pick delivery sensor 3 detects this condition and generates a delivery-over signal which is then passed to the central processing unit 1.

On receipt of this signal, the central processing unit 1 delivers first a first solenoid start command and next, with a slight time lag, a third solenoid start command. The commands are both passed to the first weft reservoir U1. As a result, on the first weft reservoir U1, the first solenoid is activated to advance the first control pin P1 into its operative zone on the reservoir drum and the third solenoid is next activated to drive the third control pin P3 for recession from its operative zone. The weft reserved on the upstream side of the third control pin P3 now slides on the conical section of the reservoir drum towards the delivery end in order to be taken over by the first control pin P1.

Slightly after input of the delivery-over signal, the central processing unit 1 delivers a third solenoid start command which is passed to the first weft reservoir U1. On receipt of this command, the third solenoid is activated to advance the third control pin P3 again into its operative zone on the reservoir drum. Right after this movement of the third control pin P3, the central processing unit 1 passes a drive motor start command to the weft reservoir U1 in which the drive motor is activated to rotate the yarn guide. By this rotation of the yarn guide, weft is wound on the reservoir drum on the upstream side of the third control pin P3.

When weft for one pick has been reserved on the upstream side of the third control pin P3, the accumulator 5 counts up to deliver a count-up signal which is then passed to the central processing unit 1. The central processing unit 1 thereupon passes a drive motor stop command to the weft reservoir U1. The drive motor is deactivated and the yarn guide ceases rotation.

In the case of the foregoing embodiment, the delivery-over signal is generated by the one-pick delivery sensor arranged on the weft arrival side of the loom. As a substitute, an additional delivery counter C′ may be arranged near the delivery end of the reservoir drum.

This delivery counter C′ may be same in type as the above-described wind-number counter C, and located on the delivery end side of the control pin for governing delivery of weft from the reservoir drum. In the case of the illustrated embodiment, the delivery counter C′ is located on the delivery end side of the first control pin P1. During delivery of weft, weft is unwound from the reservoir drum while forming balloons. Every time the weft in a balloons intersects the beam issued from the beam projector of the delivery counter C′, the delivery counter counts the unwind of weft and delivers a count signal. The delivery counter is connected to a suitable count accumulator such as the count accumulator 5 used for the wind-number counters C1 to C4. When the accumulation reaches a full count value set for the count accumulator, the count accumulator delivers a count-up signal which is used as a delivery-over signal corresponding to that generated by the one-pick delivery sensor 3. The delivery-over signal so generated is passed to the central processing unit 1.

Figure 5:
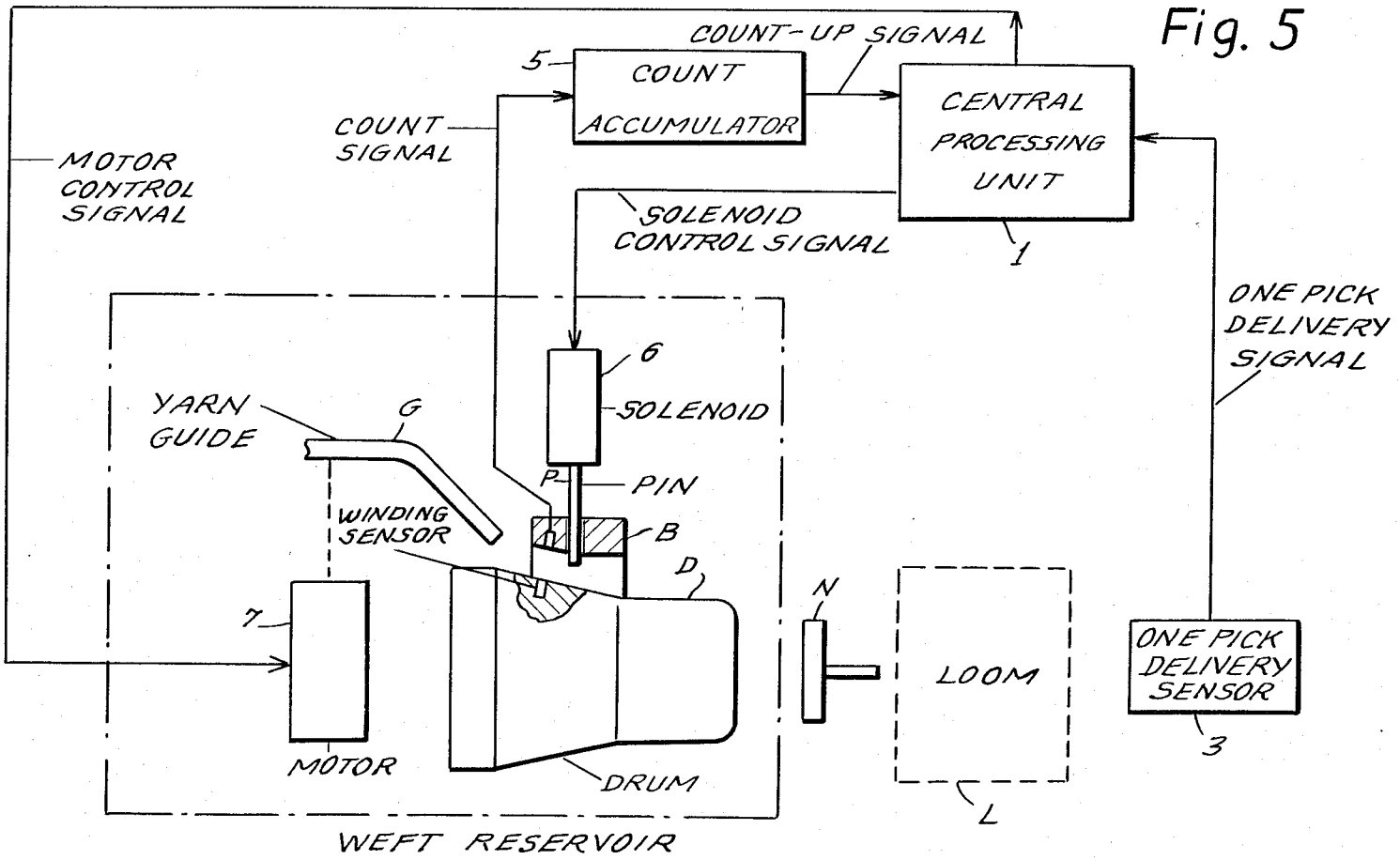
FIG. 5 is a simple five block diagram showing a weft reservoir controller in accordance with the present invention.

A simplified block diagram of the invention, showing only a single weft reservoir is set forth in FIG. 5. This diagram is particularly useful in understanding the manner in which the present invention carries out a weft reservation operation wherein a length of weft equal to a single pick of weft is reserved on the reservoir drum D, substantially independently of the operation of the loom L. Various elements of FIGS. 1–4 have been omitted in FIG. 5 since they are not necessary for explaining this feature of the invention.

The weft reservation operation is initiated when a single pick of yarn has past through the entire shed of a loom L. As described above, this can be detected by a one pick delivery sensor 3 located on the weft arrival side of loom L. When one pick delivery sensor 3 detects the arrival of the weft, it generates a one pick delivery signal which is applied to the central processing unit (more generally a control circuit) 1. The central processing unit 1 responds to this signal by generating both a solenoid control signal and a motor control signal. The solenoid signal is applied to solenoid 6 which causes the pin P (e.g. pin P 1 of FIG. 3) to move into the operative position adjacent the drum D. The motor control signal is applied to a motor 7 which causes the yarn guide G to rotate about the drum D. This results in revolutions of weft being applied to and reserved on the drum D. Each time a new revolution of weft is reserved on the drum D, the weft crosses the path of the sensor P and the sensor generates a count signal in response thereto. When a number of weft revolutions corresponding to a length of weft equal to a single pick of weft is applied to the drum D, the count accumulator 5 will have counted a predetermined number of count signals and will generate the count-up signal at its output. This signal is applied to central processing unit 1 which then terminates the weft reservation operation by generating a motor control signal (or alternatively removing the motor control signal) so as to stop the motor 7 and thereby cease application of yarn to the drum D. In this manner, weft is reserved on the drum D substantially independently of the operation of the loom L.

As is clear from the foregoing description, in the system of the present invention, the winding function of weft reservoirs is controlled by a combination of the count-up signal and the delivery-over signal which are both quite unrelated to the operational sequence of a loom for which the weft reservoirs are used. Whereas the delivering function of the weft reservoirs is controlled as a function of the weft-insertion command which is closely related to the operational sequence of the loom. In this way, the winding function of the weft reservoirs is completely separated from their delivering function. As a consequence, no advanced sequence adjustment is required at any weft reservoirs and this enables easy and smooth introduction of automation in the process of freely changeable alternate weaving.

I claim:

1. Apparatus for reserving weft on a weft reservoir associated with a loom, said apparatus comprising:

a weft reservoir including a reservoir drum, a yarn guide, a motor for causing relative movement between said yarn guide and said reservoir drum as a function of motor control signals applied thereto, and control pins driven by solenoids between an operative position wherein they catch the weft wound on the reservoir drum by the relative rotation of said yarn guide and said reservoir drum and an inoperative position wherein they release said caught weft, said solenoids moving said control pins between said operative and inoperative positions as a function of solenoid control signals applied thereto;

a winding detector for generating a count signal each time a single revolution of weft is wound about said reservoir drum;

a count accumulator coupled to said winding detector for counting the number of count signals generated by said detector, said count accumulator generating a count-up signal each time it counts a predetermined number of count signals which correspond to the length of weft equal to a single pick of weft for said loom;

means for generating a one pick delivery signal each time a single pick of weft has been inserted into a shed on said loom; and a control circuit for generating appropriate solenoid and motor control signals to initiate a weft reservation operation, wherein a single length of weft equal to a single pick of weft is reserved on said reservoir drum, causing said motor to initiate said relative rotation between said yarn guide and said reservoir drum each time said one pick delivery signal is generated and for terminating said weft reservation operation by causing said motor to stop said relative rotation between said yarn guide and said reservoir drum in response to the generation of said count-up signal.

2. Apparatus according to claim 1, further including a preparation switch coupled to said central processing unit and generating a preparation winding signal when turned on, said central processing unit generating appropriate solenoid and motor signals in response to said preparation winding signal to cause a length of weft equal to at least a single pick of weft, to be reserved on said drum.

3. Apparatus according to claim 2, wherein said means comprising a one pick delivery sensor located on the weft arrival side of said loom and detects the fact that a weft inserted into a shed of said loom has reached said arrival side of said loom.

4. Apparatus according to claim 2, wherein said means comprises a delivering counter for counting the number of weft windings on said reservoir drum which pass a predetermined position on said reservoir drum located downstream of said pins in the delivery direction of said weft.

* * * * *